US006601250B1

(12) United States Patent
Taylor

(10) Patent No.: US 6,601,250 B1
(45) Date of Patent: Aug. 5, 2003

(54) BED SHEET WITH POCKETS

(76) Inventor: Larry L. Taylor, 16330 N. Fox Hills Dr., Surprise, AZ (US) 85374

( * ) Notice: Subject to any disclaimer, the term of this patent is extended or adjusted under 35 U.S.C. 154(b) by 0 days.

(21) Appl. No.: 09/876,975

(22) Filed: Jun. 8, 2001

(51) Int. Cl.[7] ..... A47G 9/02
(52) U.S. Cl. ..... 5/485; 5/482; 5/699
(58) Field of Search ..... 5/694, 482, 485

(56) References Cited

U.S. PATENT DOCUMENTS 3,120,721 A * 2/1964 Bukatman et al. ..... 5/485
4,064,576 A 12/1977 Threatt
4,129,909 A 12/1978 Riehl
5,111,544 A 5/1992 Graebe
D341,285 S 11/1993 Kraus
5,279,009 A 1/1994 Putka, Jr.
5,581,829 A 12/1996 Lee
6,178,574 B1 * 1/2001 Stromatt et al. ..... 5/485
6,292,963 B1 * 9/2001 Couture ..... 5/485

FOREIGN PATENT DOCUMENTS

GB 2173095 A * 10/1986 ..... 5/485

* cited by examiner

*Primary Examiner*—Michael F. Trettel

(57) ABSTRACT

A bed sheet with pockets for storing a wide variety of objects and items for greater organization in a bedroom. The bed sheet with pockets includes a sheet of material having a top side and also having top and side edges; and also includes pocket members being securely attached to the sheet of material near the side and top edges thereof and being adapted to be disposed along sides of a mattress upon the sheet of material being placed upon the mattress; and further includes fastening members being attached to the sheet of material and to the pocket members for closing the pocket members.

6 Claims, 2 Drawing Sheets

BED SHEET WITH POCKETS

BACKGROUND OF THE INVENTION

1. Field of the Invention

The present invention relates to pocketed bed sheets and more particularly pertains to a new bed sheet with pockets for storing a wide variety of objects and items for greater organization in a bedroom.

2. Description of the Prior Art

The use of pocketed bed sheets is known in the prior art. More specifically, pocketed bed sheets heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,279,009; 5,111,544; 5,581,829; 4,129,909; 4,064,576; and U.S. Pat. No. Des. 341,285.

While these devices fulfill their respective, particular objectives and requirements, the aforementioned patents do not disclose a new bed sheet with pockets. The inventive device includes a sheet of material having a top side and also having top and side edges; and also includes pocket members being securely attached to the sheet of material near the side and top edges thereof and being adapted to be disposed along sides of a mattress upon the sheet of material being placed upon the mattress; and further includes fastening members being attached to the sheet of material and to the pocket members for closing the pocket members.

In these respects, the bed sheet with pockets according to the present invention substantially departs from the conventional concepts and designs of the prior art, and in so doing provides an apparatus primarily developed for the purpose of storing a wide variety of objects and items for greater organization in a bedroom.

SUMMARY OF THE INVENTION

In view of the foregoing disadvantages inherent in the known types of pocketed bed sheets now present in the prior art, the present invention provides a new bed sheet with pockets construction wherein the same can be utilized for storing a wide variety of objects and items for greater organization in a bedroom.

The general purpose of the present invention, which will be described subsequently in greater detail, is to provide a new bed sheet with pockets which has many of the advantages of the pocketed bed sheets mentioned heretofore and many novel features that result in a new bed sheet with pockets which is not anticipated, rendered obvious, suggested, or even implied by any of the prior art pocketed bed sheets, either alone or in any combination thereof.

To attain this, the present invention generally comprises a sheet of material having a top side and also having top and side edges; and also includes pocket members being securely attached to the sheet of material near the side and top edges thereof and being adapted to be disposed along sides of a mattress upon the sheet of material being placed upon the mattress; and further includes fastening members being attached to the sheet of material and to the pocket members for closing the pocket members.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new bed sheet with pockets which has many of the advantages of the pocketed bed sheets mentioned heretofore and many novel features that result in a new bed sheet with pockets which is not anticipated, rendered obvious, suggested, or even implied by any of the prior art pocketed bed sheets, either alone or in any combination thereof.

It is another object of the present invention to provide a new bed sheet with pockets which may be easily and efficiently manufactured and marketed.

It is a further object of the present invention to provide a new bed sheet with pockets which is of a durable and reliable construction.

An even further object of the present invention is to provide a new bed sheet with pockets which is susceptible of a low cost of manufacture with regard to both materials and labor, and which accordingly is then susceptible of low prices of sale to the consuming public, thereby making such bed sheet with pockets economically available to the buying public.

Still yet another object of the present invention is to provide a new bed sheet with pockets which provides in the apparatuses and methods of the prior art some of the advantages thereof, while simultaneously overcoming some of the disadvantages normally associated therewith.

Still another object of the present invention is to provide a new bed sheet with pockets for storing a wide variety of objects and items for greater organization in a bedroom.

Yet another object of the present invention is to provide a new bed sheet with pockets which includes a sheet of material having a top side and also having top and side edges; and also includes pocket members being securely attached to the sheet of material near the side and top edges thereof and being adapted to be disposed along sides of a mattress upon the sheet of material being placed upon the mattress; and further includes fastening members being attached to the sheet of material and to the pocket members for closing the pocket members.

Still yet another object of the present invention is to provide a new bed sheet with pockets that is easy and convenient to us.

Even still another object of the present invention is to provide a new bed sheet with pockets that prevents the user from losing or misplacing smaller types of objects and items.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
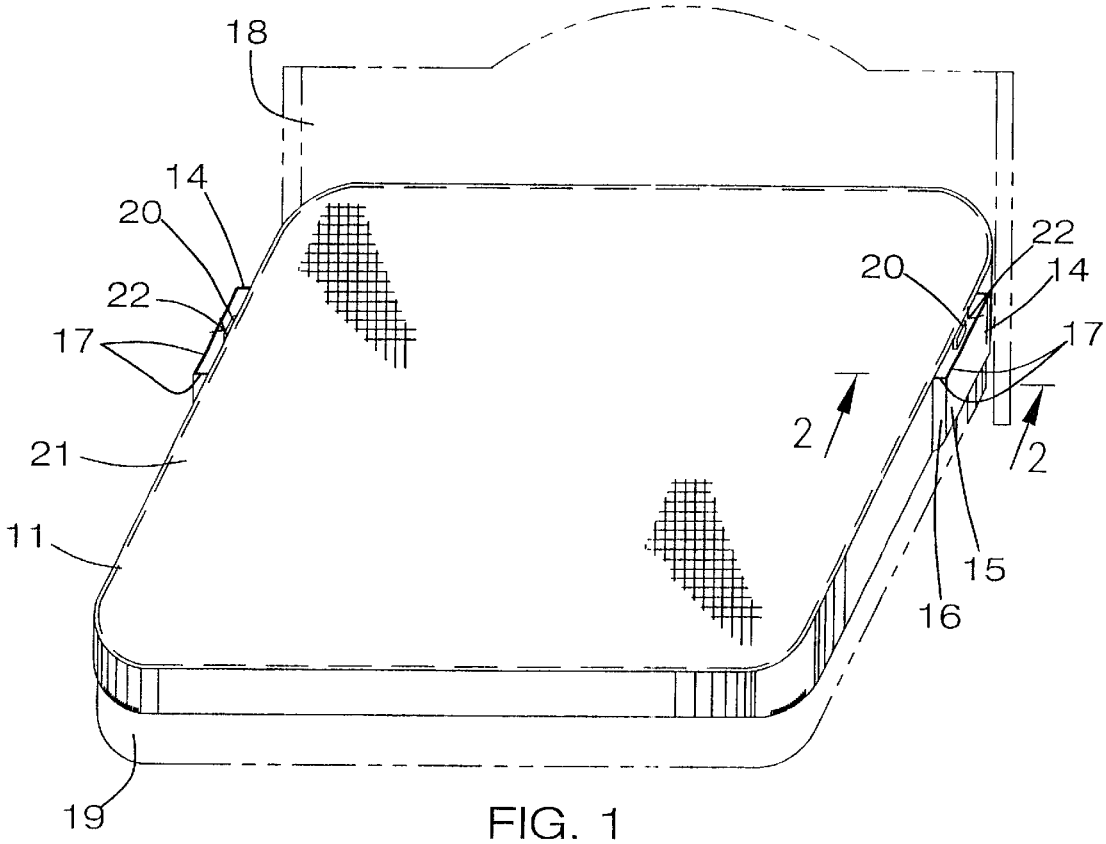
FIG. 1 is a perspective view of a new bed sheet with pockets according to the present invention and shown being used on a bed.
Figure 2:
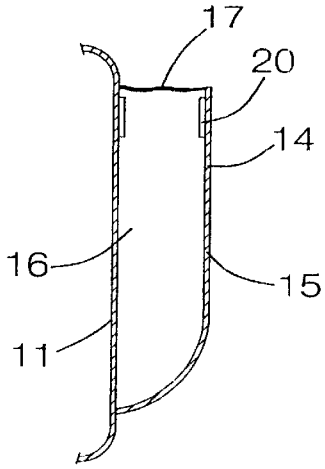
FIG. 2 is a cross-sectional view of one of the pocket members of the present invention.
Figure 3:
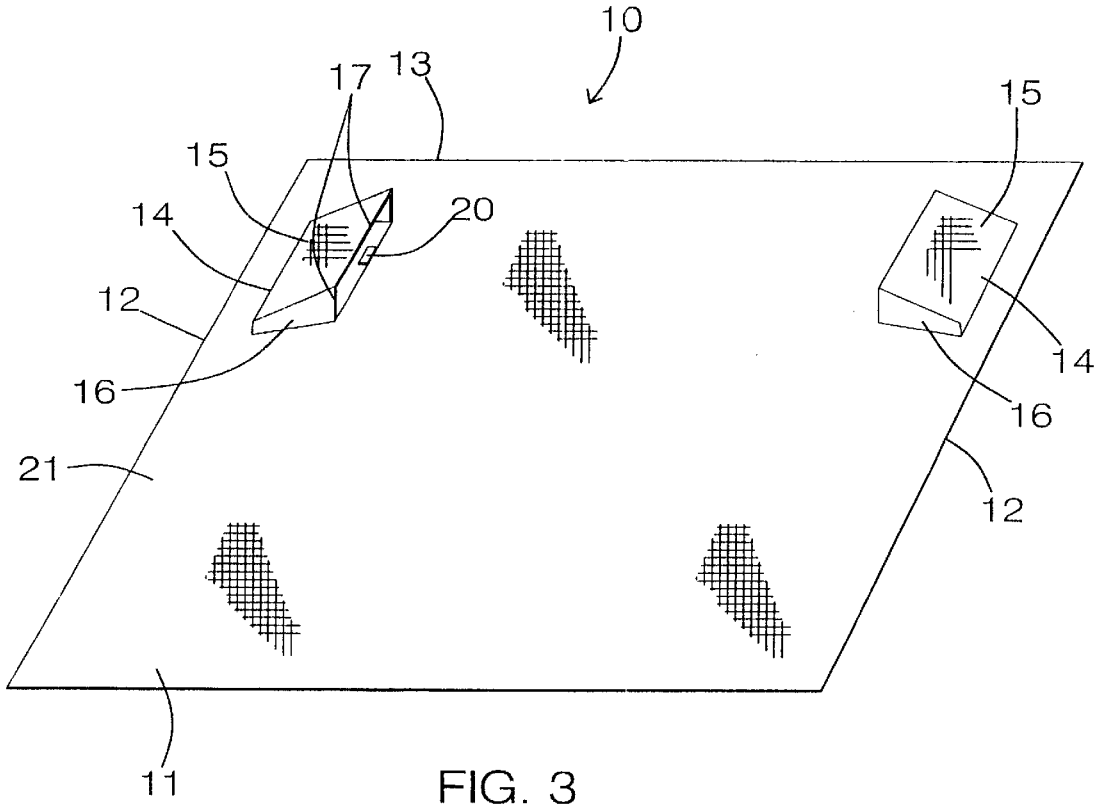
FIG. 3 is a top plan view of the present invention.

With reference now to the drawings, and in particular to FIGS. 1 through 3 thereof, a new bed sheet with pockets embodying the principles and concepts of the present invention and generally designated by the reference numeral 10 will be described.

As best illustrated in FIGS. 1 through 3, the bed sheet with pockets 10 generally comprises a sheet of material 11 having a top side 21 and also having top and side edges 12,13. Pocket members 14 are securely and conventionally attached to the sheet of material 11 near the side and top edges 12, 13 thereof and are adapted to be disposed along sides of a mattress 19 upon the sheet of material 11 being placed about the mattress 19. Each of the pocket members 14 includes front and side walls 15,16 and also includes an opening 22 through which objects and items are stored in the pocket member 14. Each of the pocket members 14 further includes elastic bands 17 being conventionally disposed along top edges of the front and side walls 15,16 for biasedly closing the opening to safely secure the objects and items in the pocket member 14. The pocket members 14 are conventionally disposed near top corners of the sheet of material 11. Fastening members 20 are conventionally attached to the sheet of material 11 and to the pocket members 14 for closing the pocket members 14. The fastening members 20 are strips of hook and loop fasteners being securely and conventionally attached inside the pocket members 14 for closing said openings 22 of the pocket members 14.

In use, the user would open the pocket members 14 and placed certain items and objects in the pocket members 14 and close the pocket members 14 using the fastening members 20 to safe keep the items and objects stored in the pocket members 14.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to. those skilled in the art, it is not desired to limit the invention to the exact construction and operation shown and described, and accordingly, all suitable modifications and equivalents may be resorted to, falling within the scope of the invention.

I claim:

1. A bed sheet with pockets comprising:

a sheet of material having an outer surface and a perimeter edge, said sheet having a top portion for positioning against a top of a mattress and a perimeter portion extending about the top portion adjacent to the perimeter edge for positioning adjacent to a perimeter side wall of a mattress, said sheet of material being continuous between said perimeter;

a pair of pocket members being positioned adjacent to the outer surface of said perimeter portion of said sheet and being securely attached to the sheet of material against the outer surface of said sheet, said pocket members being positioned at opposite locations on said perimeter portion of said sheet such that said pocket members are positionable adjacent to opposite locations on the perimeter side wall of the mattress upon the sheet of material being placed about the mattress; and fastening members being attached to said sheet of material and to said pocket members for closing said pocket members.

2. A bed sheet with pockets as described in claim 1, wherein each of said pocket members includes front and side walls defining an interior of the pocket and defining an opening through which objects and items are stored in the interior of the pocket.

3. A bed sheet with pockets as described in claim 2, wherein each of said pocket members further includes elastic bands being disposed along top edges of said front and side walls for biasedly closing said opening to safely secure the objects and items in said pocket member.

4. A bed sheet with pockets as described in claim 1, wherein said pocket members are disposed near top corners of said sheet of material.

5. A bed sheet with pockets as described in claim 2, wherein said fastening members are strips of hook and loop fasteners being securely attached inside said pocket members for closing said openings of said pocket members.

6. A bed sheet with pockets comprising:

a sheet of material having an outer surface and a perimeter edge, said sheet having a top portion for positioning against a top of a mattress and a perimeter portion extending about the top portion adjacent to the perimeter edge for positioning adjacent to a perimeter side wall of a mattress, said sheet of material being continuous between said perimeter;

a pair of pocket members being positioned adjacent to the outer surface of said perimeter portion of said sheet and being securely attached to the sheet of material against the outer surface of said sheet, said pocket members being positioned at opposite locations on said perimeter portion of said sheet such that said pocket members are positionable adjacent to opposite locations on the perimeter side wall of the mattress upon the sheet of material being placed about the mattress; and fastening members being attached to said sheet of material and to said pocket members for closing said pocket members;

wherein each of said pocket members includes front and side walls defining an interior of the pocket and defining an opening through which objects and items are stored in the interior of the pocket;

wherein each of said pocket members further includes elastic bands being disposed along top edges of said front and side walls for biasedly closing said opening to safely secure the objects and items in said pocket member;

wherein said pocket members are disposed near top corners of said sheet of material; and wherein said fastening members are strips of hook and loop fasteners being securely attached inside said pocket members for closing said openings of said pocket members.

* * * * *